US007506383B2

(12) United States Patent
Chard

(10) Patent No.: US 7,506,383 B2
(45) Date of Patent: Mar. 24, 2009

(54) NECK AND CLOTHING PROTECTOR AND METHOD OF USING SAME

(76) Inventor: Linda J. Chard, 1346 E. Rosa Cir., Sandy, UT (US) 84092

( * ) Notice: Subject to any disclaimer, the term of this patent is extended or adjusted under 35 U.S.C. 154(b) by 512 days.

(21) Appl. No.: 11/205,592

(22) Filed: Aug. 17, 2005

(65) Prior Publication Data

US 2007/0039084 A1 Feb. 22, 2007

(51) Int. Cl.
*A41D 27/16* (2006.01)

(52) U.S. Cl. ..... 2/50; 2/60

(58) Field of Classification Search ..... 2/50, 2/60, 468, 135, 129, 131–134, 136, 143, 2/46, 48, 49.1–49.5, 51, 52
See application file for complete search history.

(56) References Cited

U.S. PATENT DOCUMENTS 1,518,293 A * 12/1924 Zang ..... 2/50
2,029,417 A * 2/1936 Forster ..... 2/50
2,116,685 A * 5/1938 Nicolet ..... 2/50
2,544,487 A * 3/1951 Caluthis ..... 2/50
2,634,420 A * 4/1953 Jackson ..... 2/60
3,213,464 A * 10/1965 Lewis ..... 2/50
3,949,875 A * 4/1976 Catania et al. ..... 206/390
4,190,903 A * 3/1980 Kinsella ..... 2/60
4,442,552 A 4/1984 Bolick et al.
4,653,119 A * 3/1987 Kaiser ..... 2/60
4,709,420 A 12/1987 Gettinger
4,953,232 A * 9/1990 Gaines et al. ..... 2/60
5,491,844 A 2/1996 Kehl et al.
5,809,568 A 9/1998 Morris-Jones
5,991,919 A 11/1999 Baggetto
5,996,119 A * 12/1999 Anderberg ..... 2/50
6,836,901 B2 * 1/2005 Hippensteel ..... 2/60
7,080,413 B1 * 7/2006 Schneider ..... 2/60

OTHER PUBLICATIONS

"Graham Sanek Neck Strips," CacheBeauty.com Aug. 1, 2005 11:28:07 AM. <http://secure.cachebeautysupplies.com/iwwidb.pvx?;multi_item_submit>.
"Graham CelluCotton," CacheBeauty.com Aug. 1, 2005 11:30:15 AM. <http://secure.cachebeautysupplies.com/iwwidb.pvx?;multi_item_submit>.
"Sanek Neck Strips," FolicaPRO.com Aug. 1, 2005 11:34:59 AM. <http://www.folicapro.com/salonbasics/sanekstrips.htm>.

* cited by examiner

*Primary Examiner*—Amy B Vanatta
(74) *Attorney, Agent, or Firm*—Morriss O'Bryant Compagni

(57) ABSTRACT

The invention includes a neck and clothing protector and method of using same that are especially designed for use in the cosmetology industry. Embodiments of the protector may include a rectangular strip of textured, flexible waterproof material of preselected dimensions wherein the protector is integral and does not have any scoring or perforations passing through its rectangular surface.

17 Claims, 7 Drawing Sheets

NECK AND CLOTHING PROTECTOR AND METHOD OF USING SAME

FIELD OF THE INVENTION

The present invention relates generally to methods and apparatuses for protecting salon client's clothing during various cosmetology procedures such as shampooing and coloring. More particularly, the present invention relates to embodiments of a disposable neck and clothing protector and methods of using same during such beauty treatment operations.

BACKGROUND OF THE INVENTION

Most salon styling and coloring procedures begin with a thorough shampooing. When a client's hair is washed by a cosmetologist, the client sits in a chair which reclines toward a specially shaped sink. The sink is shaped to receive the client's head while the client's neck rests on a scoop in the sink that is specially shaped for this purpose. This allows the client's head and hair to extend into the sink basin. A spray nozzle connected to a flexible hose may then be manipulated by the cosmetologist in order to wet the client's hair, shampoo and rinse as desired. In order to fully clean and rinse the hair, the nozzle may be directed up underneath the client's head and toward the client's neck.

Various devices have been used to cover the client in an attempt to prevent water from splashing or dripping onto the client's clothes or the reclining chair. One such device is a towel that may be tucked into the client's collar. While towels are absorbent and can readily be used to dry the client's hair after shampooing, they also tend to become wetted by the shampooing and rinsing procedures. Additionally, the cotton material in towels may wick the moisture and thereby transmit the moisture to the client's clothing underneath the towel. This may be a minor inconvenience for some clients. But, for other clients, especially those wearing dry clean only clothing, it is a serious problem that requires the client or the salon to pay for dry cleaning of the contaminated clothes. Another drawback with using conventional towels is that they must be laundered after each procedure, thus, requiring additional expenditure of time, energy and money on behalf of the salon, which is undesirable.

Another device commonly used in salons is the plastic or vinyl cape which is placed over the client and secured to the client's neck prior to cutting, styling or coloring procedures. These conventional plastic capes typically have a cotton tape edge binding which may be used directly on the client's skin. Alternatively, plastic capes may be used on top of sanitary cotton, tissue or other suitable wicking material, e.g., Sanek® Neck Strips, placed first around the client's neck. The absorbent neck strip combined with the plastic cape might be preferred over the cape alone because of sanitary aspects relating to the reuse of the cape. While this combination of an absorbent neck strip and cape may be suitable for most cutting, styling or coloring procedures, it is generally unsuitable for protecting the client's clothing during shampooing. This is because the capes may be loosely secured about the neck area and, thus, do not provide a water tight seal with or without an absorbent neck strip. Furthermore, the absorbent neck strip can also provide a wicking action similar to the conventional towel and procedure described above. And finally, Sanek® Neck Strips may dissolve or disintegrate when wet, which is undesireable in the shampooing and rinse procedure.

Yet another conventional approach to solving this problem is known as the double drape method which combines the use of a cape with two towels. According to the double drape method, a first towel is placed lengthwise across the client's shoulders, crossing the ends of the towel beneath the client's chin. Then a plastic cape is wrapped over the first towel and fastened at the back of the client's neck. Finally, a second towel is wrapped around the client's neck and the ends of the second towel are again brought together under the client's chin. There are a couple of drawbacks with the double drape method. First, double draping is too bulky for the client and the stylist. The towels become wet and uncomfortable then generally have to be removed for easier access for the service being performed. Second, double draping doubles the amount of towels that must be laundered for each client serviced thus increasing costs, which is undesirable. A conventional single drape method that eliminates the second towel of the double drape method still fails to solve the problem of wetting the client's clothing and also tends to be bulky, though not as much so as the double drape method.

One attempt to solve this problem has been to use thin plastic sheets used to wrap food and the like, which may be placed around the client's shoulders and tucked under the client's collar. This provides a water impervious layer that may have some efficacy in protecting the client's clothing. However, such plastic sheeting materials are generally uncomfortable because they stick to the client's skin. Furthermore, because the plastic wrap readily sticks to itself, the plastic wrap is difficult to dispense and place over the clothing of the client. Generally, such plastic wrap material is not precut to size, thus, increasing the time and energy of the cosmetologist performing the desired procedure.

Other solutions to this ongoing problem have been proposed. U.S. Pat. No. 4,709,420 to Gettinger describes a cape having a separate back splash guard panel that prevents splashing through the open back portion of the cape below the neck line during shampooing. But the Gettinger cape still suffers from the lack of sealing and wicking problems of conventional capes.

U.S. Pat. No. 5,809,568 to Morris-Jones describes disposable bibs made of absorbent material that have a flap which may folded over to provide a neck opening and a second layer of absorbent material. While the Morris-Jones bib could be used in salon procedures, it is not moisture impervious and would leave the problem of protecting a client's clothing during shampooing unsolved.

U.S. Pat. No. 5,491,844 to Kehl et al. and U.S. Pat. No. 4,442,552 to Bolick et al. disclose bibs with layers of liquid impervious materials, thus, improving on the Morris-Jones bib. The Kehl et al. and Bolick et al. bibs could conceivably be used in the salon context. However, the Kehl et al. bib is designed for use in a dental office and does not wrap completely around the client's neck. The Bolick et al. bib has a triangular hole for insertion of the client's head, thus, surrounding the neck. However, the Bolick et al. bib head opening also fails to provide a water tight seal around the neck.

U.S. Pat. No. 5,991,919 to Baggetto describes a stay dry collar that includes a triangular tuck panel that can be tucked underneath the client's collar with end portions that may be tied around the client's neck to secure the Baggetto device in place. The Baggetto device is flexible and moisture impermeable, thus, avoiding the wicking problem associated with the above-described devices and methods. The Baggetto device provides adequate protection directly behind the neck and for the client's clothing that it surrounds. However, the Baggetto device does not protect the client's clothing all the way around the neck. This is a problem immediately after completion of the rinse procedure and as the client sits up from the reclining chair for drying of the hair. Additionally, the Baggetto device may be uncomfortable when tied around the client's neck and the procedure for placing and tying the Baggetto device is time consuming for the cosmetology professional.

It would be advantageous to have a comfortable, disposable neck and clothing protector that is impervious to liquids and, thus, protects the client's clothing during shampooing procedures. It would also be advantageous if this protector were capable of being wrapped all the way around the client's neck to provide protection to the front side of the client's clothing as well as the back side. Thus, there still exists a need in the art for an improved neck and clothing protector and method of using same.

BRIEF SUMMARY OF THE INVENTION

The invention includes a neck and clothing protector and method of using same that are especially designed for use in the cosmetology industry. Embodiments of the protector may include a rectangular strip of textured, flexible waterproof material of preselected dimensions wherein the protector is integral and does not have any scoring or perforations passing through its rectangular surface.

Embodiments of a disposable, single-use neck and clothing protector for use in cosmetology services are disclosed according to the present invention. The protector may include a rectangular strip of textured, flexible waterproof material having a width, W, ranging from about 2 inches to about 4 inches, a length, L, ranging from about 14 inches to about 18 inches and a thickness, t, ranging from about 0.0015inches to about 0.003 inches according to embodiments of the present invention.

Embodiments of a method of protecting the neck and clothing of a cosmetology client using the inventive protector are also disclosed according to the present invention.

The foregoing apparatuses, methods and other features, utilities, and advantages of the invention will be apparent from the following detailed description of the invention with reference to the accompanying drawings.

BRIEF DESCRIPTION OF THE DRAWINGS

The following are brief descriptions of the drawings illustrating embodiments of the present invention. Additionally, like reference numerals refer to like parts in different views of the drawings. It should be noted that the elements shown within the drawings may not be shown to scale.

DETAILED DESCRIPTION OF THE INVENTION

Figure 1:
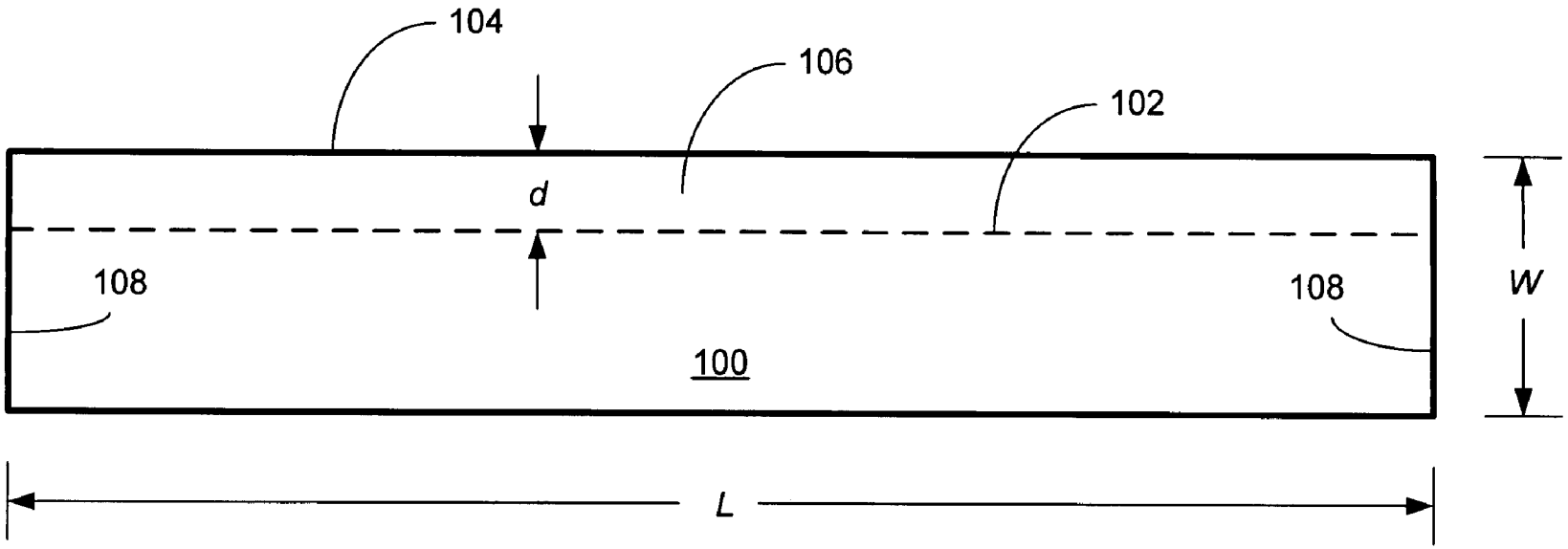
FIG. 1 is a plan view of an embodiment of a neck and clothing protector according to the present invention.

FIG. 1 is a plan view of an embodiment of a neck and clothing protector 100 according to the present invention. Protector 100 is designed to be a disposable, single-use neck and clothing protector for use in various cosmetology services, including shampooing, hair cuts, and styling and coloring procedures. Protector 100 may be generally rectangular in shape and formed of a textured, flexible waterproof material having a width, W, ranging from about 2 inches to about 4 inches, a length, L, ranging from about 14 inches to about 18 inches and a thickness, t, ranging from about 0.0015 inches to about 0.003 inches, wherein the protector is integral and does not have any scoring or perforations passing through its rectangular surface. The lack of scoring or perforations prevents leakage of water, chemicals or other contaminants through the textured, flexible waterproof material and provides structural integrity for the intended purpose of protector 100.

The textured, flexible waterproof material may be a thermoplastic polymer material according to embodiments of the present invention. The thermoplastic polymer material may comprise any suitable thermoplastic polymer material, for example and not by way of limitation, polyethylene, ethylene copolymers, polypropylene, polypropylene copolymers, polystyrene, polystyrene copolymers, polyvinyl alcohol, vinyl alcohol copolymers, polyvinyl chloride, vinyl chloride copolymers, polyvinyl acetate and vinyl acetate copolymers, according to various embodiments of protector 100.

Protector 100 may further include a marking 102 (shown in dotted line) running parallel to a lengthwise edge 104 of the protector 100 indicating an approximate fold line for a portion 106 of the protector configured to be tucked underneath a client's collar (not shown in FIG. 1) according to another embodiment of the present invention. The marking 102 may be spaced a distance, d, from a lengthwise edge 104 of the protector 100 according to an embodiment of the present invention. According to yet another embodiment of the present invention the distance, d, may be in the range from about 1 inch to about 5 inches. Protector 100 further includes opposing widthwise ends 108 which may be tucked under a client's chin.

Figure 2:
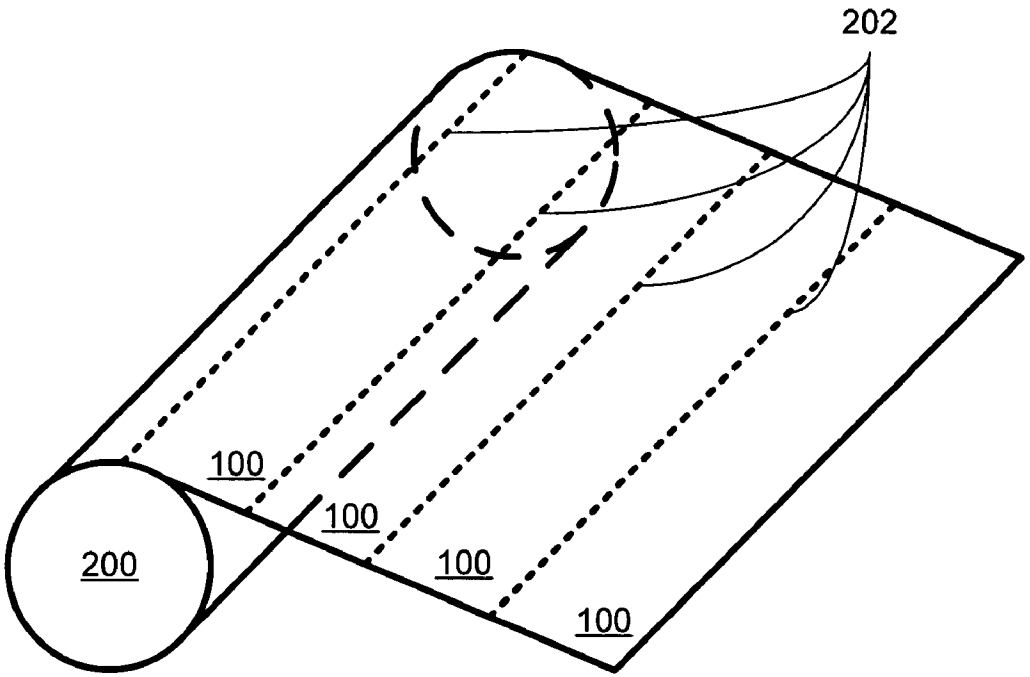
FIG. 2 is a perspective view of an embodiment of a plurality of the protectors each adjoined along lengthwise edges with perforations to allow for easy separation during dispensing according to the present invention.

FIG. 2 is a perspective view of an embodiment of a plurality of the protectors 100 each adjoined along lengthwise edges with perforations 202 to allow for easy separation during dispensing according to the present invention. As shown in FIG. 2, the plurality of protectors 100 may be configured in a roll 200 for dispensing.

Figure 3:
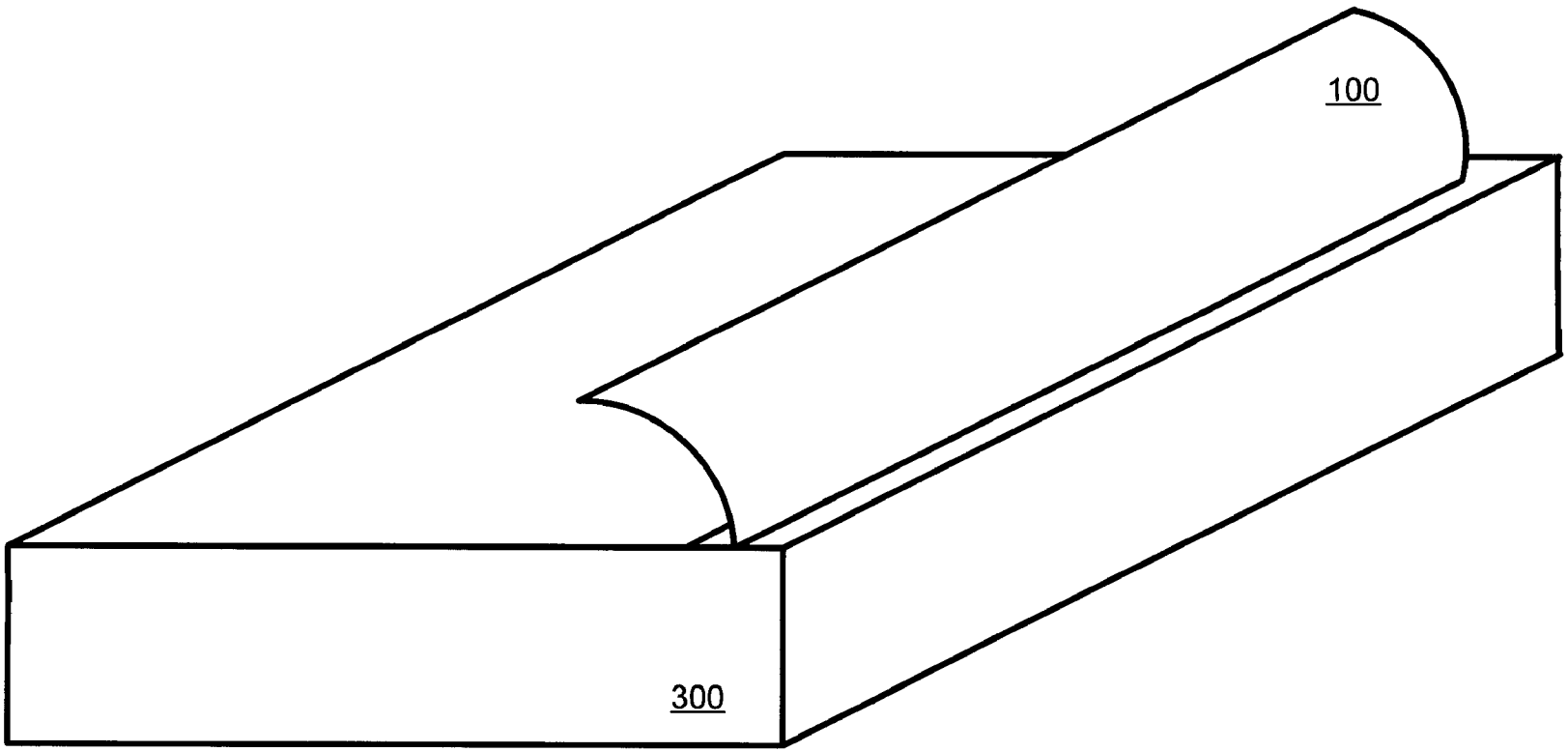
FIG. 3 is a perspective view of an embodiment of a plurality of the protectors disclosed herein each stacked on top of each other for ease of dispensing according to the present invention.

FIG. 3 is a perspective view of an embodiment of a plurality of the protectors 100 stacked on top of each other for ease of dispensing according to the present invention. As shown in FIG. 3, the plurality of protectors 100 may include a box 300 having an opening for dispensing the stacked protectors.

The surface of a protector 100 may be soft and textured, but is not glossy in order to inhibit sticking to a client's skin according to an embodiment of the present invention. This is a particularly desirable feature because it improves over the conventional plastic wrap approach to solving the problem, because conventional plastic wrap is glossy and sticks to the client's skin. Thermoplastic polymer materials formed as closed-cell foam provides a suitable textured, flexible and soft material suitable for protector 100. The thickness, t, of the thermoplastic polymer material used for embodiments of protector 100 of the present invention may range from about 0.0015 inches to about 0.003 inches.

Additional embodiments of protector 100 may be color coded, silk screened with identification or otherwise marked to indicate particular sizes. Various sizes of protector 100, e.g., small, medium and large sizes may be provided for use with correspondingly sized clients. The use of different colored polystyrene protectors 100, each different color corresponding to a different size would allow for immediate visual identification of the particular size of the protector 100. Of course, marking each protector with a written indictor of size, e.g., silk screened markings, would also be within the scope of embodiments of the present invention.

Figure 4:
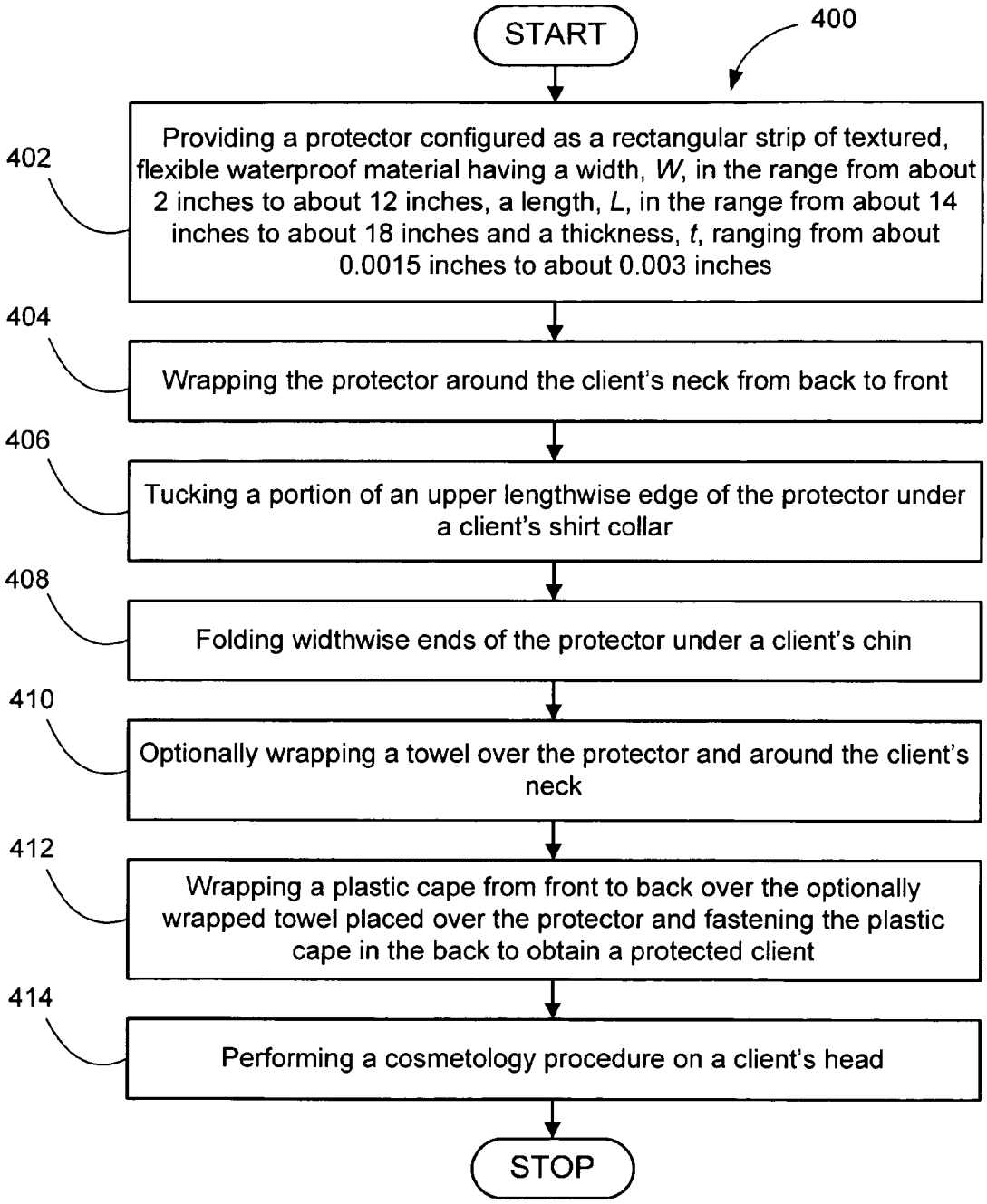
FIG. 4 is a flow chart of an embodiment of a method of protecting the neck and clothing of a cosmetology client according to the present invention.

FIG. 4 is a flow chart of an embodiment of a method 400 of protecting the neck and clothing of a cosmetology client according to the present invention. Method 400 may include providing 402 a protector 100 as described above, i.e., configured as a rectangular strip of textured, flexible waterproof material, e.g., thermoplastic polymer material, having a width, W, ranging from about 2 inches to about 12 inches, a length, L, ranging from about 14 inches to about 18 inches and a thickness, t, ranging from about 0.0015 inches to about 0.003 inches according to an embodiment of the present invention. Providing 402 a protector 100 may include providing a rectangular strip of textured, flexible waterproof material having a width, W, of about 3 inches, a length, L, of about 17 inches and a thickness, t, of about 0.0017 inches according to a particular embodiment of the present invention.

Method 400 may further include wrapping 404 the protector 100 around the client's neck from back to front and tucking 406 a portion 106 of an upper lengthwise edge 104 of the protector 100 under a client's shirt collar according to an embodiment of the present invention. This feature of method 400 more fully protects the client's clothing by the liquid impervious protector surrounding the client's collar, thus, eliminating wetting or contamination by chemicals.

Method 400 may further include folding 408 widthwise ends 108 of the protector 100 under a client's chin according to an embodiment of the present invention. During shampooing procedures there is less need for protection of the front collar portion of the client's clothing. However, immediately after shampooing and rinsing, the client sits up and water or other contaminates could soil the client's front collar portion by simply dripping down along the client's skin. Thus, the protector 100 according to method 400 allows for full protection of the client's clothing, i.e., both back and front.

Method 400 may further include optionally wrapping 410 a towel around the protector and the client's neck. Method 400 may also be practiced without wrapping 410 a towel around the protector and the client's neck. Method 400 may further include wrapping 412 a plastic cape over the protector and the optionally wrapped towel from front to back and fastening the plastic cape in the back to obtain a protected client according to embodiments of the present invention.

Method 400 may further include performing 414 a cosmetology procedure on the client's head according to an embodiment of the present invention. The cosmetology procedure may be, for example and not by way of limitation: cleaning the client's hair by shampooing, rinsing, conditioning and rinsing, cutting the client's hair, styling, coloring, makeup application or any other suitable procedure that might be applied to the client's head whereby protection according to the methods and devices of the present invention is desirable.

When the cosmetology procedure is completed, or at any other time that the client or cosmetologist desires to remove the protector 100, method 400 may further include unprotecting the client by reversing the aforementioned method steps 402-412 to return the client to original configuration according to an embodiment of the present invention.

Figure 5:
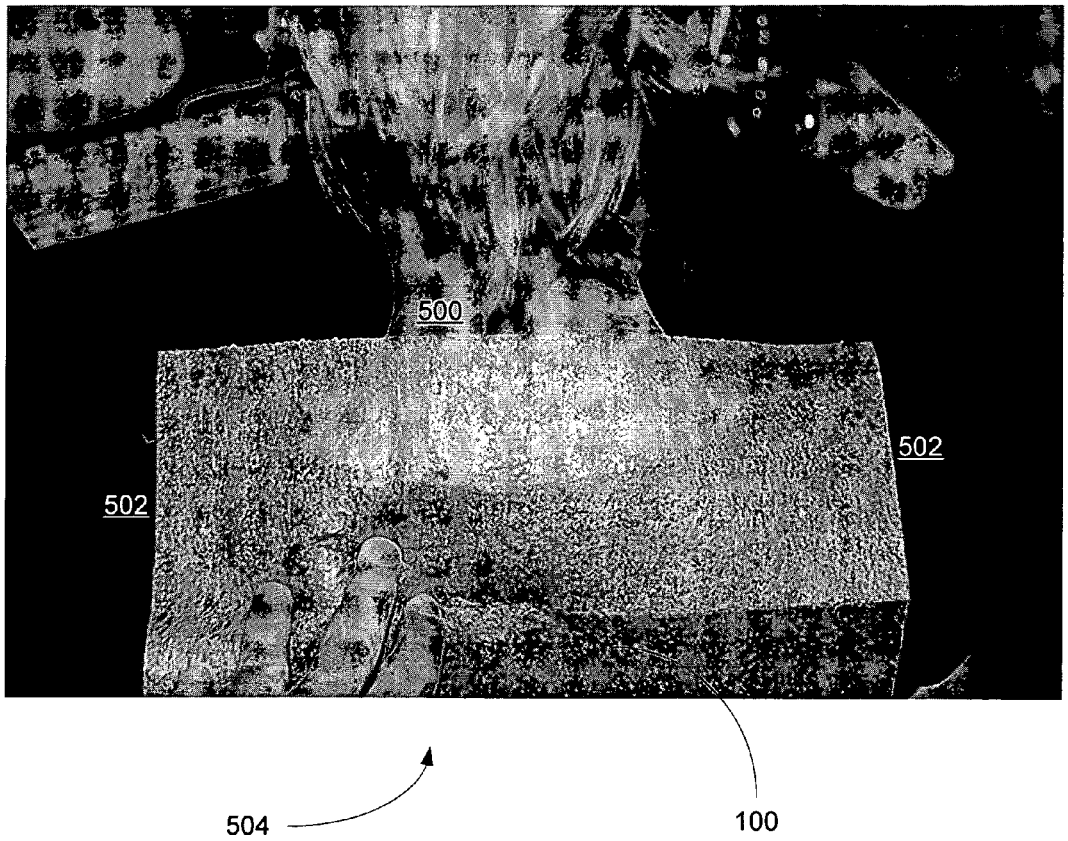
FIG. 5 is an image of an embodiment of a protector placed onto a client's neck and shoulders as viewed from the back and prior to being tucked into a client's shirt collar, according to a method embodiment of the present invention.
Figure 6:
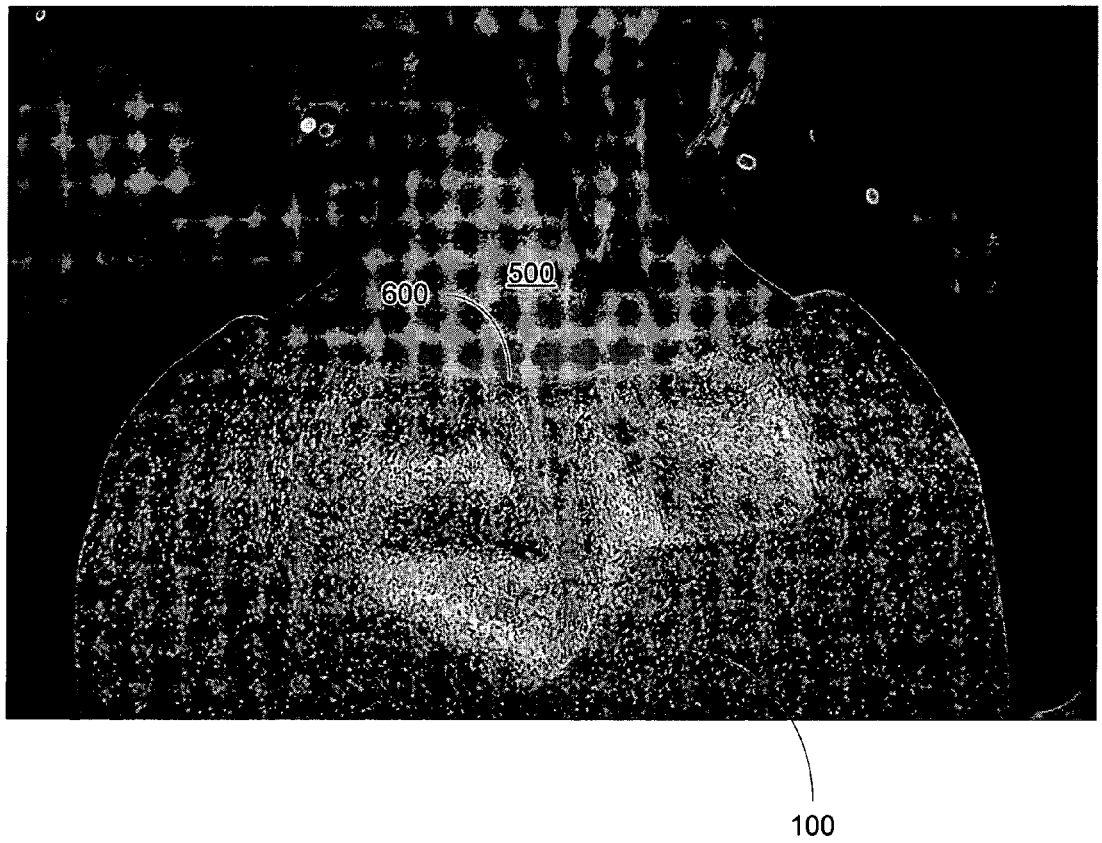
FIG. 6 is an image of the protector of FIG. 6 after tucking the protector into the client's shirt collar, according to a method embodiment of the present invention.
Figure 7:
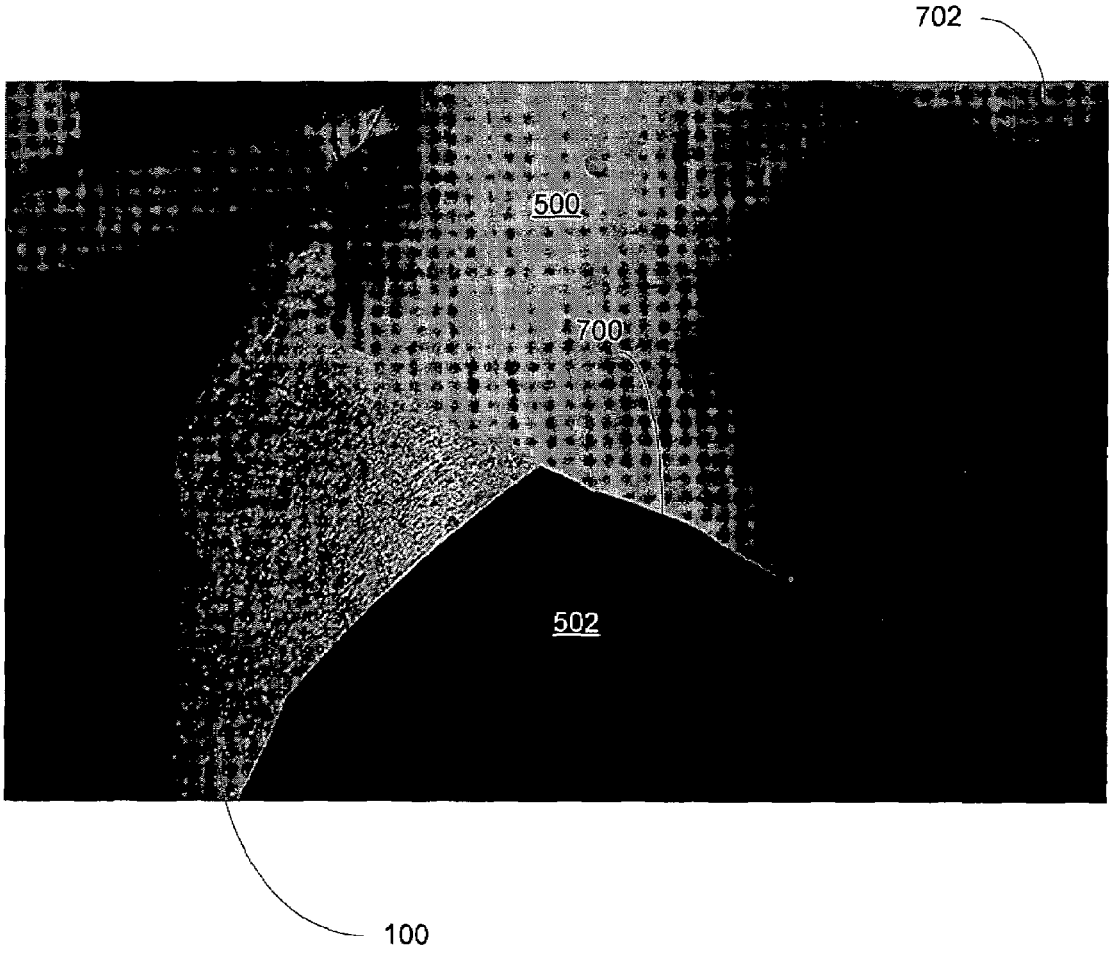
FIG. 7 is a side view of the tucked protector of shown in FIG. 6, according to a method embodiment of the present invention.

FIG. 5 is an image of an embodiment of a protector 100 placed onto a client's neck 500 (see also FIGS. 6-7) and shoulders 502 (see also FIG. 7) as viewed from the back, shown generally at arrow 504, and prior to being tucked into a client's shirt collar (underneath protector 100, and see 700 in FIG. 7). FIG. 5 also illustrates the wrapping 404 step of method 400 (FIG. 4).

FIG. 6 is an image of the protector 100 shown in FIG. 6 after tucking the protector 100 into the client's shirt collar. The client's shirt collar is not shown in FIG. 6, but, it is located underneath protector 100 at neckline 600. The client's shirt collar is shown at 700 in FIG. 7. FIG. 6 also illustrates the tucking 406 step of method 400 (FIG. 4).

FIG. 7 is a side view of the tucked protector 100 shown in FIG. 6. As seen in FIG. 7, the embodiment of protector 100 is of a length that does not wrap completely around underneath the client's chin 702. Other embodiments of protector 100 (not shown) may be of sufficient length that the widthwise ends of the protector 100 could be folded over each other under the client's chin 702 as described in the folding 408 step of method 400. However, the folding 408 step is inherently optional depending on the length and configuration of protector 100 relative to the client's neck size.

The invention, as defined by the claims below, is intended to cover all changes and modifications to the embodiments of the invention as described herein which do not depart from the spirit of the invention. The words "including" and "having," as used in the specification, including the claims, shall have the same meaning as the word "comprising."

Although this invention has been described with reference to particular illustrated embodiments, the invention is not limited to the embodiments described. Rather, it should be understood that the embodiments described herein are merely exemplary and that a person skilled in the art may make many variations and modifications without departing from the spirit and scope of the invention as defined by the following claims.

What is claimed is:

1. A method of protecting the neck and clothing of a cosmetology client, comprising:

providing a protector configured as a rectangular strip of textured, flexible, homogenous and waterproof thermoplastic polymer material having a width, W, in the range from about 2 inches to about 12 inches, a length, L, in the range from about 14 inches to about 18 inches and a thickness, t, ranging from about 0.0015 inches to about 0.003 inches;

wrapping the protector around the client's neck from back to front;

tucking a portion of an upper lengthwise edge of the protector under a client's shirt collar; and wrapping a plastic cape from front to back over an optionally wrapped towel placed over the protector and fastening a plastic cape around the client's neck and over the protector to obtain a protected client.

2. The method according to claim 1, further comprising performing a cosmetology procedure on a client's head.

3. The method according to claim 1, further comprising unprotecting the client by reversing the aforementioned method steps to return the client to original configuration.

4. The method according to claim 1, further comprising wrapping the optional towel over the protector and around the client's neck from back to front after folding the widthwise ends of the protector and before wrapping the plastic cape.

5. The method according to claim 1, wherein providing a protector comprises providing a rectangular strip of textured, flexible waterproof material having a width, W, of about 3 inches, a length, L, of about 17 inches and a thickness, t, of about 0.0017 inches.

6. The method according to claim 1, wherein providing a thermoplastic polymer material comprises providing at least one of polyethylene, ethylene copolymers, polypropylene, polypropylene copolymers, polystyrene, polystyrene copolymers, polyvinyl alcohol, vinyl alcohol copolymers, polyvinyl chloride, vinyl chloride copolymers, polyvinyl acetate and vinyl acetate copolymers.

7. A disposable, single-use neck and clothing protector for use in cosmetology services, comprising a rectangular strip of textured, flexible, homogenous and waterproof thermoplastic polymer material having a width, W, in the range from about 2 inches to about 12 inches, a length, L, in the range from about 14 inches to about 18 inches and a thickness, t, ranging from about0.0015inches to about 0.003 inches, wherein the protector is integral and does not have any scoring or perforations passing through its rectangular surface.

8. The protector according to claim 7, further comprising a plurality of the protectors each adjoined along lengthwise edges with perforations to allow for easy separation during dispensing.

9. The protector according to claim 8, wherein the plurality of protectors are configured in a roll for dispensing.

10. The protector according to claim 7, further comprising a plurality of the protectors stacked on top of each other for ease of dispensing.

11. The protector according to claim 10, further comprising a box having an opening for dispensing the stacked protectors.

12. The protector according to claim 7, further comprising a marking running parallel to a lengthwise edge of the protector indicating an approximate fold line for a portion of the protector configured to be tucked underneath a client's collar.

13. The protector according to claim 12, wherein the marking is spaced a distance, d, from the lengthwise edge of the protector and wherein the distance, d, is in the range from about 1 inch to about 5 inches.

14. The protector according to claim 7, wherein the surface of the protector is soft and textured, but is not glossy in order to inhibit sticking to a client's skin.

15. The protector according to claim 7, wherein the protector is color-coded to indicate particular sizes.

16. The protector according to claim 7, wherein the protector is silk screened with identification to indicate particular sizes.

17. The protector according to claim 7, wherein the thermoplastic polymermaterial comprises at least one of polyethylene, ethylene copolymers, polypropylene, polypropylene copolymers, polystyrene, polystyrene copolymers, polyvinyl alcohol, vinyl alcohol copolymers, polyvinyl chloride, vinyl chloride copolymers, polyvinyl acetate and vinyl acetate copolymers.

* * * * *